United States Patent [19]

Willis

[11] 4,135,536

[45] Jan. 23, 1979

[54] TIP MEMBERS FOR CRUTCHES AND THE LIKE

[76] Inventor: Wilburn C. Willis, Rte. 2, Hagerstown, Ind. 47346

[21] Appl. No.: 825,681

[22] Filed: Aug. 18, 1977

[51] Int. Cl.[2] ..... A45B 9/04

[52] U.S. Cl. ..... 135/84; 135/78

[58] Field of Search ..... 135/77, 82, 83, , 84, 135/78; 248/188.9; 280/11.37 P; 16/36

[56] References Cited

U.S. PATENT DOCUMENTS

| | | | |
|---|---|---|---|
| 748,068 | 12/1903 | Hammond et al. | 135/84 |
| 1,305,867 | 6/1919 | Atlas | 135/78 |
| 1,314,193 | 8/1919 | Hipwood | 135/82 |
| 2,453,742 | 11/1948 | Bowen et al. | 135/77 |
| 2,910,995 | 11/1959 | Jacuzzi | 135/77 |
| 3,199,886 | 8/1965 | Dover | 135/84 X |

*Primary Examiner*—Price C. Faw, Jr.

*Assistant Examiner*—Conrad L. Berman

*Attorney, Agent, or Firm*—Arnold B. Silverman

[57] ABSTRACT

A resilient tip member, preferably molded as a unit from rubber, having a gripper pad, a crutch holder and an interposed sleeve portion. A pivot pin preferably has a disc-like upper portion disposed within the crutch holder, and a depending pin portion extending through the sleeve portion and into the gripper pad. An instep plate is disposed within the gripper pad and has an upwardly concave portion of generally complementary configuration with respect to the lower end of the depending pin portion with the two being in contact.

Means for introducing lubricant into the contacting portions of the pivot pin and instep plate may be provided. Traction means may be removably or permanently secured to the ground engaging portion of the resilient tip member.

18 Claims, 12 Drawing Figures

TIP MEMBERS FOR CRUTCHES AND THE LIKE

BACKGROUND OF THE INVENTION

1. Field of the Invention

This invention relates to improved tip members for crutches, canes, walking sticks and the like and, more specifically, relates to such tips wherein free relative rotational movement may be provided between the ground contacting portion and crutch, cane or walking stick receiving portion of the tip.

2. Description of the Prior Art

In connection with crutch tips and tips for like articles, such as canes or walking sticks, for example, one of the problems which has occurred is that of obtaining consistently reliable, effective ground engagement between the pad placed over the free end of a crutch or like article and floors, earth, walkways and the like. Not only does this present a safety hazard in that improper contact can result in falls which are injurious to the user, but, in addition, during the course of walking, as the crutch is frequently at various angles with respect to the ground when weight is applied thereto, wearing of the surfaces occurs rapidly and further contributes to inefficient and undesirable and hazardous contact.

It has previously been recognized that effective ground engagement of the tip member may be preserved while permitting relative angular positions of the crutch or like member, thereby contributing to more efficient performance of the article. Among the approaches which have previously been taken to accomplish this objective are reliance upon resiliency of the tip member with angular displacement of the crutch resulting in predetermined bending of the tip member while preserving the ground engaging portion thereof in contact with the ground. See U.S. Pat. Nos. 1,055,111; 2,230,406 and 3,467,117.

U.S. Pat. No. 909,827 discloses a multi-piece crutch tip member having upper and lower resilient portions and an interposed metal disc with the prime connection being made by a metal pin having heads positioned within recesses in the two resilient members.

U.S. Pat. No. 3,741,226 discloses a specifically formed lower crutch portion cooperating with an insert member which provides a socket for the lower crutch portion. See also U.S. Pat. No. 879,471.

A number of rather complex, multiple piece ball and socket type structures for use with canes have been suggested. See U.S. Pat. Nos. 994,194 and 1,348,531.

There remains, therefore, a need for an effective, reliable and economical means for permitting relative angular displacement between a crutch, cane, walking stick or like member and the ground or floor, in such fashion as to not only facilitate efficient mechanical performance of the device, but also to provide maximum security against undesired falls, maximum efficiency of performance of the structure, increased service life and adaptability to various types of climate variations.

SUMMARY OF THE INVENTION

The present invention has solved the above-described problems by establishing a unique combination of mechanical joint and resilient tip member which is versatile, durable and dependable. The tip of the present invention provides a resilient tip member having a gripper pad, a crutch holder and an interposed sleeve portion. The pivot pin, which preferably has a disc-like upper portion and a depending pin portion, has the disc-like portion positioned within the crutch holder and extends through the sleeve portion and into the gripper pad. An instep plate having an upwardly concave portion is disposed within the gripper pad and receives the lower end of the pin portion. Relative angular and rotational movement between the two metal parts is freely permitted.

In one embodiment of the invention, an axial bore is provided in the pivot pin to permit the introduction of lubricant into the joint. A lubricant reservoir may be provided within the gripper pad.

The invention also contemplates the use of traction means, such as would be advantageous in ice or snow, in order to obtain more firm engagement between the base of the gripper pad and the snow or ice.

The invention also contemplates so proportioning the various components and so shielding the metal components from entry of foreign matter that reliability over an extended period of time is facilitated.

It is an object of the present invention to provide a tip member for crutches, canes, walking sticks and the like so as to permit efficient mechanical performance and maximum ground engagement even when the crutch or similar article is oriented at an angle displaced from the perpendicular with respect to the floor or ground.

It is another object of this invention to provide such an article which is economical to manufacture and reliable over a prolonged period of use.

It is a further object of the present invention to provide such a construction where the moving parts are lubricated, the entry of foreign matter into the moving parts is resisted and means are provided for unusual weather conditions so as to enhance the stability of engagement between the tip and the ground or floor.

It is another object of this invention to provide a crutch tip which is adapted for use with conventional crutches, canes an walking sticks.

It is another object of the present invention to provide such a tip wherein the geometry of the moving parts, as well as the resilient tip portion, is such as to contribute to maximum strength and effective performance.

These and other objects of the invention will be more fully understood from the following description of the invention on reference to the illustrations appended hereto.

DESCRIPTION OF THE PREFERRED EMBODIMENTS

As used herein, the term "crutch" shall include not only crutches but also canes, walking sticks and other items adapted to provide support to a human being during walking, standing or changing positions and shall include the so-called "walkers" which frequently contain multiple legs and are often used by recuperating cardiac patients, the elderly and others. It is to be understood that while a principal use of the present invention will be in the context of crutches, for simplicity of description and claiming, the use of the expression "crutch" will have the above-defined meaning, in addition to its normal meaning.

Figure 1:
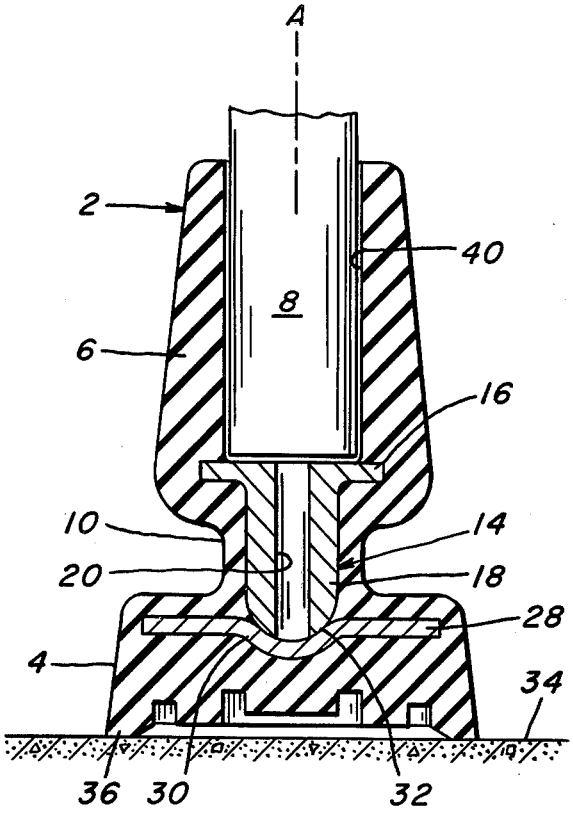
FIG. 1 is a cross-section illustration of one form of tip member of the present invention.

Referring now more specifically to FIG. 1, there is shown a resilient tip member 2, which, in the form shown, has been molded as a unit from rubber, which has three sections, i.e. gripper pad 4, crutch holder 6 and an interposed sleeve 10. The lower portion of a crutch 8 is shown received within the crutch holder 6.

Figure 2:
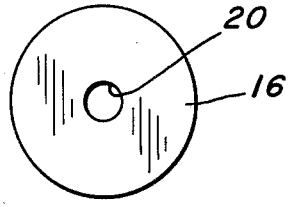
FIG. 2 is a top plan view of the pivot pin shown in FIG. 1.
Figure 3:
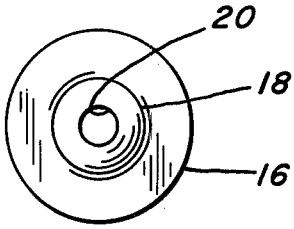
FIG. 3 is a bottom plan view of the pivot pin shown in FIG. 1.

As is shown in FIGS. 1, 2 and 3, the pivot pin 14 has a disc-like upper portion 16 and a depending pin portion 18. The pivot pin 14 defines an axial bore 20 which extends throughout its length. The axial bore 20, in the form shown, is closed by means of the lower end of crutch 8.

Figure 4:
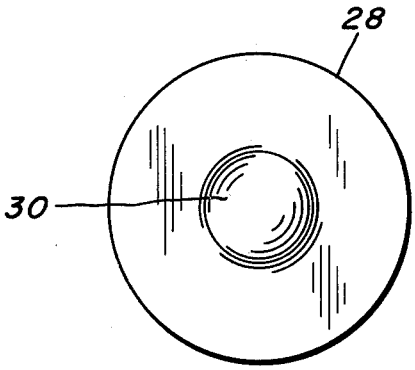
FIG. 4 is a top plan view of the instep plate shown in FIG. 1.

Referring now to FIGS. 1 and 4, the instep plate 28 will now be considered in greater detail. In the form shown, the instep plate has generally centrally located, upwardly concave portion 30 which, in the form shown, has a generally spherical upper surface configuration. The lower surface 32 of depending pin portion 18 also as a generally spherical configuration. It will be appreciated, therefore, that when crutch 8 is subjected to relative angular displacement from its perpendicular orientation with respect to ground surface 34, surface 32 may readily be subjected to movement with respect to concave portion 30 while preserving firm contact between ground engaging portion 36 of gripper pad 4 and ground 34. In addition, the surfaces will permit relative rotational movement of crutch 8 and pivot pin 14 with respect to instep plate 28 when the crutch is moved about an axis indicated as longitudinal central axis of the crutch 8 and designated by the letter "A" in FIG. 1.

Figure 5:
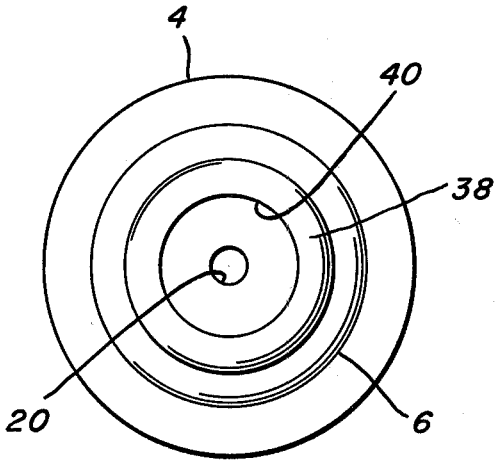
FIG. 5 is a top plan view of the resilient tip member portion of the tip shown in FIG. 1.

As is shown in FIG. 5, which is a top plan view of resilient top member 2, the crutch holder 6 has a mouth portion 38, crutch receiving recess 40 and a gripper pad portion 4.

In the form shown in FIG. 1, it will be appreciated that the dimensioning of the components contributes meaningfully to the strength and reliability of the product. While for purposes of clarity of illustration, the crutch member 8 has been shown as being spaced from the inner surfaces of the recess within which it is received, it will be appreciated that the lower portion of the crutch will generally be in direct contact with the upper surface of disc-like portion 16 of pivot pin 14 and in resilient engagement with the sidewalls of resilient crutch holder 6. In the form shown, the disc-like portion 16 and the crutch holder 6 cooperate to define a generally cylindrical recess within which crutch 8 is received. The disc-like portion 16, in the form shown, has a diameter greater than the diameter of the recess which it helps to define. Also, the instep plate 28 has a diameter which is greater than the diameter of the disc-like portion 16. This contributes to stability of the structure. It should also be noted that the structure advantageously provides a low center of gravity by establishing the movable joint within the gripper pad 4.

The embodiment of FIG. 1 illustrates a preferred means of providing sufficient lubricant for the joint established between the pivot pin 14 and instep plate 28. In this embodiment, the axial bore 20 permits the introduction of lubricant into the joint area. The crutch cooperates with the resilient crutch holder 6 to seal bore 20 and resist leakage of lubricant out of bore 20. This will serve to contribute to efficient performance of the joint over a prolonged period.

It will also be appreciated that as a result of the unitary construction of the resilient tip member 2 and the influence of crutch portion 8, the moving portions of the joint, i.e. lower portion of pivot pin 14 and the concave portion 30 of instep plate 28, are shielded from undesired entry of dirt and other foreign material which might impair the performance of the joint.

Figure 6:
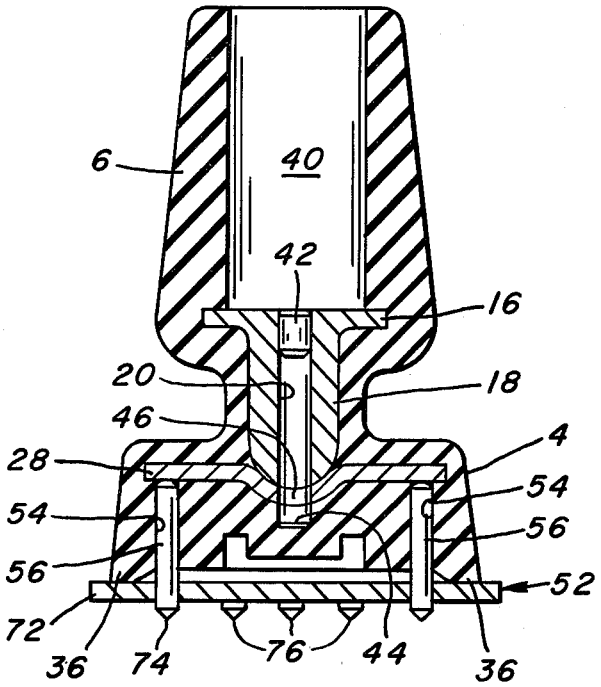
FIG. 6 is a cross-sectional illustration of a modified form of the invention shown in FIG. 1.
Figure 8:
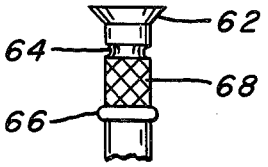
FIG. 8 is a fragmentary illustration of a form of anchoring pin employed in connection with the traction means.
Figure 7:
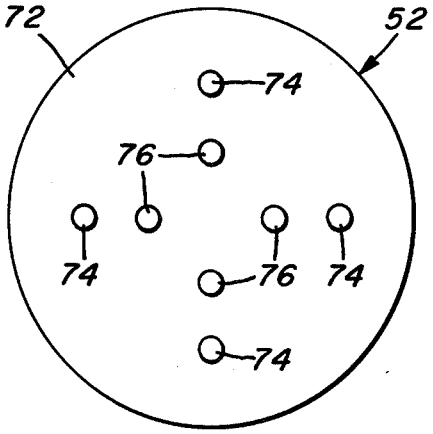
FIG. 7 is a bottom plan view of the traction means employed in the embodiment shown in FIG. 6.

Referring now to FIGS. 6 through 8, an embodiment of the invention which is particularly advantageous in situations where normal traction might be precarious, such as in ice or snow, or other unusual conditions, wherein the crutch in ice or snow, or other unusual conditions, wherein the crutch tip is provided with traction means 52 is shown. In the form shown, the gripper pad 4 is provided with a number of bores 54 within which are received a number of anchor pins 56. As a result of the resilient interengagement between the anchor pins 56 and the bores 54, the traction means 52 are firmly secured in underlying relationship with the tip and in firm contact with the ground engaging portion 36 of the gripper pad 4. In order to establish firm mechanical contact, the upper ends of the anchor pins 56 have been shown as being in contact with the instep plate 28. As a result, forces applied to the traction means 52 will be transmitted with firmness through the instep plate 28 and then to pivot pin 14, and ultimately to the crutch member. In situations where it is desired to provide some shock absorber as a cushion against such firm transmission of forces, a gap may be provided between either the upper end of bore 54 and the undersurface of instep plate 28 or the upper end of anchor pin 56 and the undersurface of instep plate 28.

In order to enhance the resilient retentive interrelationship between the anchor pins 56 and bores 54, it may be desirable to provide retention means on pins 56, such as one or more of the means illustrated in FIG. 8. For simplicity of illustration, a number of different types of means have been shown on the single pin illustrated in FIG. 8, but it will be appreciated that any one of these means may be used alone or in combination with the others shown. Shown in FIG. 8 are an enlarged pin head 62, an annular groove 64 in the shank of the pin, an outwardly projecting annular rib 66 and outwardly projecting serrations 68.

In the form shown in FIGS. 6 through 8, the traction means has a generally plate-like body 72, the anchor pins 56 and traction means 74, 76 projecting downwardly from the body portion 72. In the form shown, the traction means 74 consists of extensions of the anchor pins 56 which extensions project through the body portion 72 and project downwardly as spike elements 74. The traction means 76 consist of individual spike elements secured to the undersurface of the body 72 and projecting downwardly therefrom. Other forms of traction enhancing means may be secured in lieu of or in addition to those illustrated. It will also be appreciated that while four anchor pins 56 have been shown as being used and having projecting pins 74 (FIG. 7), any desired number which will effectively secure the traction means 52 in position may be employed.

It will be appreciated that in view of the resilient material out of which the tip member 2 is composed, the traction means 52 will be firmly retained in place during normal usage but may readily be removed for periods of use wherein the undesirable conditions do not exist on the ground surface. If desired, however, one may permanently secure the traction means 52 to the resilient tip member 2 and different tip members may be employed for different weather conditions.

Another modification shown in FIG. 6 is the use of a closure 42, which may be a removable resilient plug, in the upper end of bore 20 of pin 18 so as to provide a seal against the escape of lubricant therefrom and to resist entry of foreign matter. Also, this embodiment provides an enlarged capacity for lubricant storage by creating reservoir 44 through an upwardly open recess in gripper pad 4 and providing an opening 46 in instep plate 28 to permit communication between bore 20 and reservoir 44.

While advantageous in all embodiments in respect of lubricant confinement, in this embodiment, it is preferred to bond the undersurface of instep plate 28 to the underlying rubber with or without the use of a separate adhesive so as to resist entry of foreign matter which may enter bores 54 (particularly when traction member 52 is not in use) and then past into the joint. The edge and upper surface of instep plate 28 may also be bonded to the rubber of gripper pad 4.

Figure 9A:
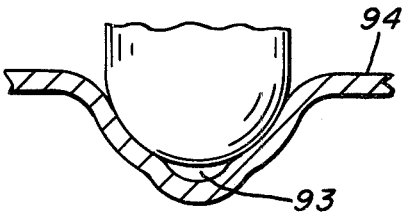
FIG. 9*a* is an enlarged cross-sectional view of the joint of FIG. 9.
Figure 9:
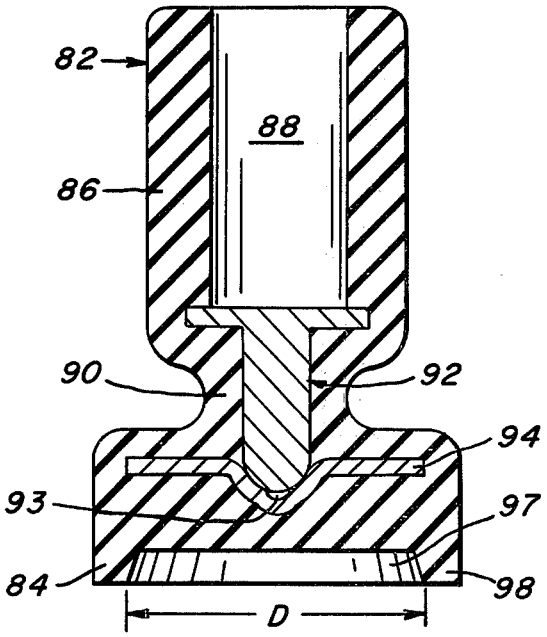
FIG. 9 is a cross-sectional illustration of another embodiment of the present invention.

Referring now to FIGS. 9 and 9*a*, a further embodiment of the present invention will now be considered. In this embodiment, the resilient tip member 82 has a gripper pad 84, crutch holder 86, which defines a crutch receiving recess 88, and sleeve 90. The pivot pin 92 is provided as a pin of solid cross-sectional area and devoid of bore 20, shown in FIG. 1. Also, the instep plate is shown as having a generally rectangular cross section with a depressed generally centrally disposed upwardly concave (although it may retain its circular configuration in plan). The concave portion is partially enlarged with respect to the lower end of pivot pin 82 to provide lubricant recess 93. In this embodiment, it is contemplated that lubricant would be introduced into the joint between the lower end of pivot pin 92 and the instep plate 94 prior to forming the article. This would provide for permanent lubrication and also permanent seal against undesirable entry of foreign material into the mechanical joint.

In the form shown, the gripper pad would not provide for vacuum engagement with the ground as the instep plate diameter is generally equal to the diameter "D" (FIG. 9) of the hollow sector 97 defined by annular portion 98 of gripper pad 84. If vacuum engagement were desired, the diameter of the instep plate should be reduced with respect to that of the hollow sector 97.

Figure 10:
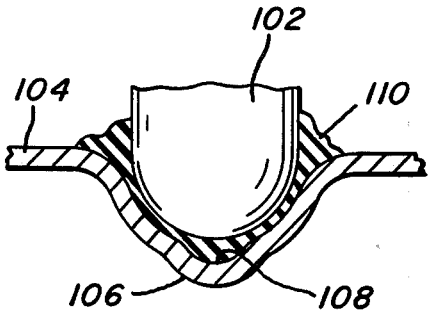
FIGS. 10 and 11 are views similar to FIG. 9*a* but showing modified embodiments.

Referring now to FIG. 10, there is shown a modified form of the invention. In this form, the lower end of pivot pin 102 has a generally complementary configuration with respect to the upwardly open concave surface defined by instep plate 104. The instep plate 104 in the form shown has a downwardly projecting, upwardly open portion 106 defining a lubricant reservoir. Interposed between pivot pin 102 and instep plate 104 and serving to resist direct physical contact therebetween is material 110. This material 110, in the form shown, extends into lubricant reservoir 106 and is preferably composed of a natural or synthetic rubber which contributes to free relative movement of pivot pin 102 with respect to instep plate 104. In a preferred embodiment, this material may be the same material out of which the gripper pad is made and may advantageously be molded or flashed as a unit therewith. In this preferred approach, a quantity of material is permitted to enter the region between pivot pin 102 and instep plate 104 during the molding operation. Alternatively, a separate web of material 110 could be inserted prior to molding. When material 110 is a resiliently compressible material, it may serve the dual function of cushioning as well as lubricating between pivot pin 102 and instep plate 104.

Figure 11:
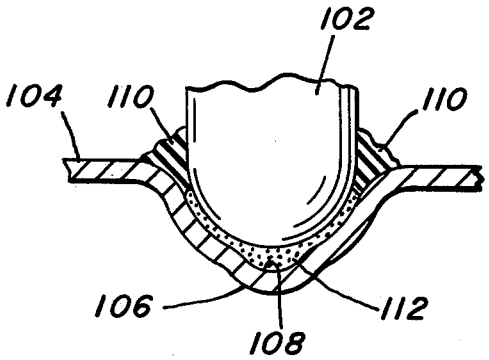

The embodiment shown in FIG. 11 is generally similar to the embodiment of FIG. 10 except that in addition to the solid portion of material 110, shown in FIG. 11, particulate portions of material 112 are provided and, in the form shown, extends into the lubricant reservoir. The solid portions of material 110 may be employed as a means retaining the particulate portions in the desired location. Particulate rubber elements 112 may be either introduced into the lubricant reservoir as such or may, in the alternative, be created by disintegration of the solid material 110, in situ, as by prolonged use of the crutch with a material 110 designed to have this effect.

While the preferred embodiment shows an upwardly concave portion of the instep plate established by forming a dimple-like portion in the instep plate, while not as advantageous, one might provide a concave recess in the plate by removal of material without appreciable alteration of the elevational cross section of the plate such as occurs by the forming approach. This approach would provide an essentially flat plate (circular in plan) with an upwardly open recess. In terms of lubricant retention and extent of pin-instep surface interengagement, this is not as desirable, however.

It will, therefore, be appreciated that the present invention has provided a crutch tip with a dependable and economical mechanical joint which is adapted to permit firm ground engagement regardless of departure of the crutch member from an orientation generally perpendicular to the ground surface and movement in various angular positions. The present invention further establishes a mechanical joint which is fully lubricated and a construction which resists the undesired entry of dirt and other foreign matter into the mechanical joint area. The crutch tip is suitable for use with conventional crutches and need not require any special adaptation. It is also, therefore, adapted to use with existing constructions. The relative geometry of the components and the position of the pivot point close to the ground provide maximum structural stability and advantageous use with a minimizing of the risk of undesired falls.

While the invention is not specifically limited to particular materials, the resilient tip member may conveniently be molded as a unit out of rubber, and the pivot pin, instep plate may advantageously be made of steel. Similarly, the traction means and the anchor pins therefor, as well as the traction member as a whole, may be made of steel. It will be appreciated by those skilled in the art that other materials may readily be substituted for these materials while preserving the benefits of the present invention.

Whereas particular embodiments of the present invention have been described above for purposes of illustration, it will be evident to those skilled in the art that numerous variations of the details may be made without departing from the invention as defined in the appended claims.

I claim:

1. A crutch tip including a unitary resilient tip member having a gripper pad, a crutch holder and an interposed sleeve portion, a pivot pin having a disc-like upper portion disposed within said crutch holder and a depending pin portion extending through said sleeve portion and into said gripper pad, an instep plate having an upwardly concave portion and being disposed within said gripper pad, said depending pin portion having a surface of generally complementary configuration with respect to said upwardly concave portion of said instep plate and being in contact with said concave portion, whereby relative movement between said pivot pin and said instep plate is permitted, said upwardly concave portion of said instep plate having an upwardly exposed, generally spherical surface, said depending pin portion surface having a generally spherical configuration, said instep plate having a diameter greater than the maximum diameter of said crutch holder, said crutch holder and said pivot pin disc-like portion cooperating to define a generally cylindrical recess for receipt of said crutch, said disc-like portion having a diameter greater than the diameter of said holder recess, and said instep plate having a diameter greater than the diameter of said disc-like portion.

2. The crutch tip of claim 1 including a lubricant reservoir formed within said upwardly concave portion of said instep plate.

3. The crutch tip of claim 1 including said resilient tip member being a molded member composed of rubber whereby entry of dirt and foreign matter into the joint where said depending pin portion contacts said instep plate will be resisted.

4. The crutch tip of claim 3 including said gripper pad defining a generally downwardly open hollow sector, said instep plate except for said upwardly concave portion being generally flat, and said instep plate having a diameter generally equal to the diameter of said hollow sector.

5. A crutch tip including a resilient tip member having a gripper pad, a crutch holder and an interposed sleeve portion, a pivot pin having a disc-like upper portion disposed within said crutch holder and a depending pin portion extending through said sleeve portion and into said gripper pad, an instep plate having an upwardly concave portion and being disposed within said gripper pad, said depending pin portion having a surface of generally complementary configuration with respect to said upwardly concave portion of said instep plate and being in contact with said concave portion, whereby relative movement between said pivot pin and said instep plate is permitted, and said pivot pin having an axial bore therethrough, whereby lubricant may be introduced into the area of contact between said depending pin portion and said instep plate.

6. The crutch tip of claim 5 including a lubricant reservoir formed within said gripper pad under said instep plate, and an opening in said instep plate establishing communication between said pivot pin axial bore and said reservoir.

7. The crutch tip of claim 6 including closure means sealing said pivot pin axial bore.

8. The crutch tip of claim 5 including said gripper pad having a ground engaging portion, said gripper pad having a number of bores open at said ground engaging portion, a traction member disposed in underlying relationship with respect to said ground engaging portion, and said traction member having a number of generally upwardly projecting anchor pins extending into said bores and secured therewithin, whereby said traction member will be removably secured to said crutch tip.

9. The crutch tip of claim 8 including said traction member anchor pins extending upwardly into contacting relationship with said instep plate.

10. The crutch tip of claim 8 including said traction member anchor pins extending upwardly to a position spaced from said instep plate.

11. The crutch tip of claim 8 including said traction member having a plate-like body portion with said anchor pins projecting generally upwardly therefrom, said traction means projecting generally downwardly therefrom, and at least a portion of said traction means being extensions of said anchor pins passing through said plate-like body portion and projecting therebelow.

12. The crutch tip of claim 8 including said anchor pins having integrally formed means for resisting undesired removal of said anchor pins from said bores.

13. The crutch tip of claim 8 including said traction means having a diameter greater than the diameter of said instep plate.

14. The crutch tip of claim 8 including said traction member having traction means projecting downwardly therefrom.

15. The crutch tip of claim 14 including said traction means including a number of spikes.

16. A crutch tip including a unitary resilient tip member having a gripper pad, a crutch holder and an interposed sleeve portion, a pivot pin having disc-like upper portion disposed within said crutch holder and a depending pin portion extending through said sleeve portion and into said gripper pad, an instep plate having an upwardly concave portion and being disposed within said gripper pads, said depending pin portion having a surface of generally complementary configuration with respect to said upwardly concave portion of said instep plate, an intermediate member interposed between said depending pin portion and said instep plate to resist direct physical contact therebetween while permitting relative movement therebetween, said intermediate member being composed of a resiliently compressible material, whereby said member will provide resilient cushioning action between said pivot pin and said instep plate.

17. The crutch tip of claim 8 including said intermediate member composed at least in part of particulate material.

18. The crutch tip of claim 8 including said intermediate member being composed of a material having lubricating properties facilitating relative movement between said pivot pin and said instep plate.

* * * * *

UNITED STATES PATENT AND TRADEMARK OFFICE

CERTIFICATE OF CORRECTION

PATENT NO. : 4,135,536

DATED : January 23, 1979

INVENTOR(S) : Wilburn C. Willis

It is certified that error appears in the above-identified patent and that said Letters Patent are hereby corrected as shown below:

Column 5, line 48, after "concave" insert --portion--.

Column 5, line 50, change "82" to --92--.

Claim 16, line 4, after "having" insert --a--.

Claim 17, line 1, change "8" to --16--.

Claim 18, line 1, change "8" to --16--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*